US012403353B2

(12) United States Patent
Williams

(10) Patent No.: US 12,403,353 B2
(45) Date of Patent: Sep. 2, 2025

(54) KNEE JOINT PHYSICAL THERAPY DEVICE

(71) Applicant: Brandon Williams, Austin, TX (US)

(72) Inventor: Brandon Williams, Austin, TX (US)

( * ) Notice: Subject to any disclaimer, the term of this patent is extended or adjusted under 35 U.S.C. 154(b) by 102 days.

(21) Appl. No.: 18/519,046

(22) Filed: Nov. 26, 2023

(65) Prior Publication Data

US 2025/0170447 A1 May 29, 2025

(51) Int. Cl.
*A63B 21/00* (2006.01)
*A63B 23/04* (2006.01)

(52) U.S. Cl.
CPC .... *A63B 21/4039* (2015.10); *A63B 21/00181* (2013.01); *A63B 21/151* (2013.01); *A63B 21/4015* (2015.10); *A63B 21/4035* (2015.10); *A63B 23/0494* (2013.01); *A63B 2208/0252* (2013.01)

(58) Field of Classification Search
CPC ..... A63B 21/00181; A63B 21/151; A63B 21/4015; A63B 21/4035; A63B 21/4039; A63B 23/0494; A63B 2208/0252
See application file for complete search history.

(56) References Cited

U.S. PATENT DOCUMENTS

| | | | | |
|---|---|---|---|---|
| 4,335,875 | A * | 6/1982 | Elkin | A63B 69/0059 482/131 |
| 5,514,059 | A * | 5/1996 | Romney | A63B 21/0552 482/121 |
| 5,681,248 | A * | 10/1997 | Vani | A63B 21/0004 482/126 |
| D406,486 | S * | 3/1999 | Ogilvie | D6/601 |
| 6,484,335 | B2 * | 11/2002 | Gilbert | A47C 7/425 5/639 |
| 6,748,615 | B1 * | 6/2004 | Tiedemann | A47C 7/383 5/636 |
| 6,751,816 | B1 | 6/2004 | Wechsler | |
| 8,632,443 | B2 | 1/2014 | Hauptmann | |
| 8,813,283 | B2 | 8/2014 | Alexander | |
| 9,168,411 | B2 * | 10/2015 | Holman | A63B 21/15 |
| 9,415,258 | B1 * | 8/2016 | Higgins | A63B 21/00065 |
| D794,814 | S * | 8/2017 | Higgins | D24/211 |
| 9,968,474 | B2 * | 5/2018 | Carpenter | A61H 1/0218 |
| 10,561,879 | B2 * | 2/2020 | Huang | A63B 21/00185 |
| 11,247,814 | B2 * | 2/2022 | Munoz | A45F 3/02 |
| 11,324,332 | B1 * | 5/2022 | Flannery | A47C 21/08 |
| 12,257,202 | B2 * | 3/2025 | Markowski | A63B 21/4023 |
| 2004/0003469 | A1 * | 1/2004 | Gill-Barajas | A47C 21/08 5/636 |
| 2011/0183825 | A1 * | 7/2011 | Yang | A63B 21/4039 482/132 |
| 2012/0065557 | A1 * | 3/2012 | Phillips | A63B 21/0552 601/99 |
| 2012/0150082 | A1 * | 6/2012 | Davis | A61H 15/0092 601/118 |

FOREIGN PATENT DOCUMENTS

| | | |
|---|---|---|
| CN | 103301606 | 5/2013 |
| KR | 101748436 | 1/2016 |

* cited by examiner

*Primary Examiner* — Joshua Lee

(57) ABSTRACT

A device for facilitating physical therapy exercises of the knee having a cylindrical or semicylindrical body having a rigid core, padding, and a vinyl cover. A strap is attached to the body at each end and may have one or more handles for grasping by a patient.

10 Claims, 4 Drawing Sheets

KNEE JOINT PHYSICAL THERAPY DEVICE

FIELD OF THE INVENTION

This disclosure relates generally to physical therapy. More specifically, it relates to a device for facilitating physical therapy exercises for the knees.

BACKGROUND

Physical therapy is often used to treat knee problems, including rehabilitation of the knee after injury or surgery. Physical therapy exercises are often performed using whatever equipment is already available, such as ropes, bands, or towels. Because these devices are not designed specifically for the required exercises, they are often cumbersome or uncomfortable to use. For example, a rolled-up towel may be used to support a joint during exercise, however, the towel may be too soft to provide adequate support or may come unrolled during the exercise. Patient rehabilitation may be hindered due to the inadequate equipment itself or by frustration caused by the inadequate equipment.

It would therefore be advantageous to have a device which avoids these and other drawbacks of existing devices.

SUMMARY OF THE INVENTION

A knee joint physical therapy device according to embodiments comprises a cylindrical body having a rigid or semi-rigid core, and a cover surrounding the core, and at least one strap attached to the cylindrical body, the at least one strap comprising a first strap end extending from a first end of the cylindrical body and a second strap end extending from a second end of the cylindrical body. The device may also comprise padding surrounding the core and between the core and the cover. The core may comprise a hollow cylinder which may be made from a polymer or may comprise a solid cylinder made of a polymer foam. The first strap end and the second strap end may comprise one or more handles which may be formed by a loop of the strap material. The device may further comprise a retaining band attached to the cylindrical body for passing a foot or both feet of a patient therethrough.

A knee joint physical therapy device according to embodiments comprises a semicylindrical body having a rigid or semi-rigid core, and a cover surrounding the core, and at least one strap attached to the semicylindrical body, the at least one strap comprising a first strap end extending from a first end of the semicylindrical body and a second strap end extending from a second end of the semicylindrical body. The device may also comprise padding surrounding the core and between the core and the cover. The core may comprise a hollow semicylinder which may be made from a polymer or may comprise a solid semicylinder made of a polymer foam. The first strap end and the second strap end may comprise one or more handles which may be formed by a loop of the strap material. The device may further comprise a retaining band attached to the semicylindrical body for passing a foot or both feet of a patient therethrough.

DETAILED DESCRIPTION

Traditional physical therapy methods make use of existing devices which may not be optimal for performing rehabilitation exercises. As a result, patient rehabilitation may be suboptimal.

To solve these and other problems with existing devices, a knee joint physical therapy device is provided herein.

A knee joint physical therapy device as described herein provides a device which provides rigid, yet comfortable support for certain exercises and provides one or more handles on a pair of straps for facilitating other exercises.

Figure 1:
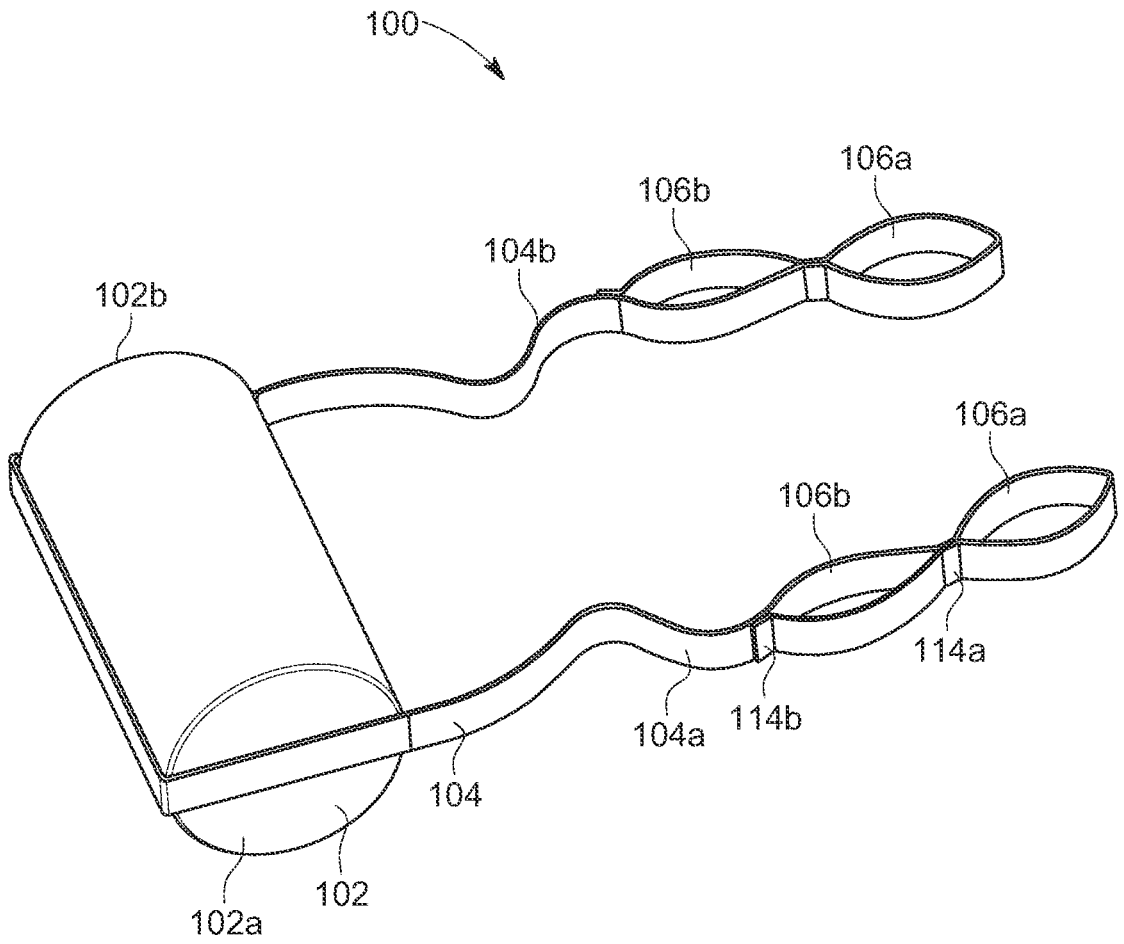
FIG. 1 depicts a perspective view of a knee joint physical therapy device according to one embodiment.

FIG. 1 depicts a perspective view of a knee joint physical therapy device 100 according to one embodiment. Knee joint physical therapy device 100 is comprised of a cylindrical body 102 having a strap 104 attached thereto. Strap 104 is attached to the cylindrical body 102 in a manner that will be described later. Strap 104 has a first strap end 104*a* and a second strap end 104*b*, the first strap end 104*a* attached to a first end 102*a* of the cylindrical body 102 and the second strap end 104*b* attached to the second end 102*b* of the cylindrical body 102. First strap end 104*a* and second strap end 104*b* each comprise a plurality of handles 106*a* and 106*b* for grasping by the patient. In other embodiments, physical therapy device 100 may comprise more than one strap. For example, the first strap end may be on a first strap attached at the first end of the cylindrical body and the second strap end may be on the second strap attached at the second end of the cylindrical body.

Figure 2:
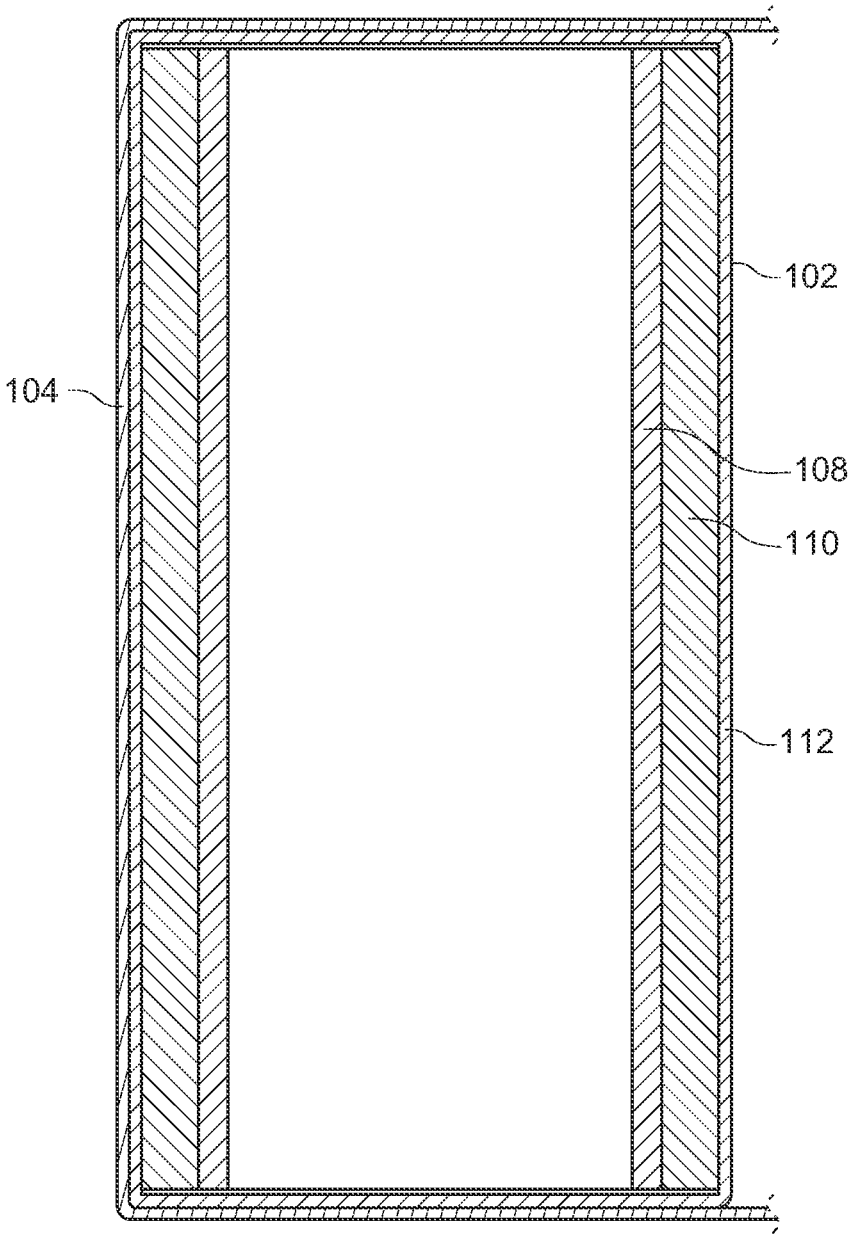
FIG. 2 depicts a cutaway view of the knee joint physical therapy device of FIG. 1.

FIG. 2 depicts a section view of cylindrical body 102. Cylindrical body 102 is comprised of a cylindrical core 108, padding 110, and cover 112. The primary purpose of cylindrical core 108 is to hold the cylindrical shape of cylindrical body 102. Cylindrical core 108 may be rigid or semi-rigid and may be comprised of a hollow cylinder or solid cylinder. The core may be extruded, injection molded, or blow molded and may be made out of polyvinylchloride (PVC), polystyrene, polyethylene or any other suitable polymer. The core may be formed of polystyrene, polyethylene or any other polymer foam which may be expanded, extruded, or otherwise formed.

Padding 110 surrounds cylindrical core 108 and may be comprised of any compliant organic or inorganic material such as stuffing, ethylene-vinyl acetate (EVA) foam, polyurethane foam, polyethylene foam, neoprene foam, urethane foam, vinyl foam, silicone foam, PVC foam, memory foam, etc. Padding 110 provides a small amount of cushion for comfort without compressing too much and losing the support of the cylindrical core 108.

Cover 112 completely surrounds padding 110 and cylindrical core 108 around the circumference and on both ends. Cover 112 is made of a leather, vinyl, or other suitable material to provide a hygienic, easy to clean surface for the device. Cover 112 may be made from one or more pieces attached to one another such as by sewing.

Strap 104 may be attached to cylindrical body 102 by being sewn to cover 112. Strap 104 may be attached to both ends of cylindrical body 102 as well as along the length of one side of the cylindrical body. Strap 104 may be made of nylon webbing, polyurethane webbing, polyester webbing, or any other suitable material. Strap 104 comprises a plurality of handles 106*a* and 106*b* on either side on the strap.

Handles 106*a* are at the ends of strap 104 and handles 106*b* are displaced between handles 106*a* and the cylindrical body 102. These handles and more may be provided, thus allowing the patient to grasp whichever handles are preferable.

The handles may be made from a loop of the strap material or may be a separate piece attached to the strap. For example, the handles may be made of a plastic or metal loop attached to the strap by sewing, rivets, etc. In the embodiment shown in FIG. 1, handles 106*a* and 106*b* are formed by folding strap 104 back on itself and securing the two pieces of strap at a first location 114*a* and a second location 114*b*.

A retaining band (not shown in FIG. 1; See e.g., FIG. 3) may be included which is comprised of a flexible material attached to the cylindrical body 102 and is designed to help hold cylindrical body 102 on a patient's foot. The retaining band is attached to cylindrical body 102 at two or more places, creating at least one opening for passing a foot or both feet of a patient therethrough. The retaining band may be made of an elastic or inelastic material, such as nylon webbing, rubber, elastic, etc.

Figure 3:
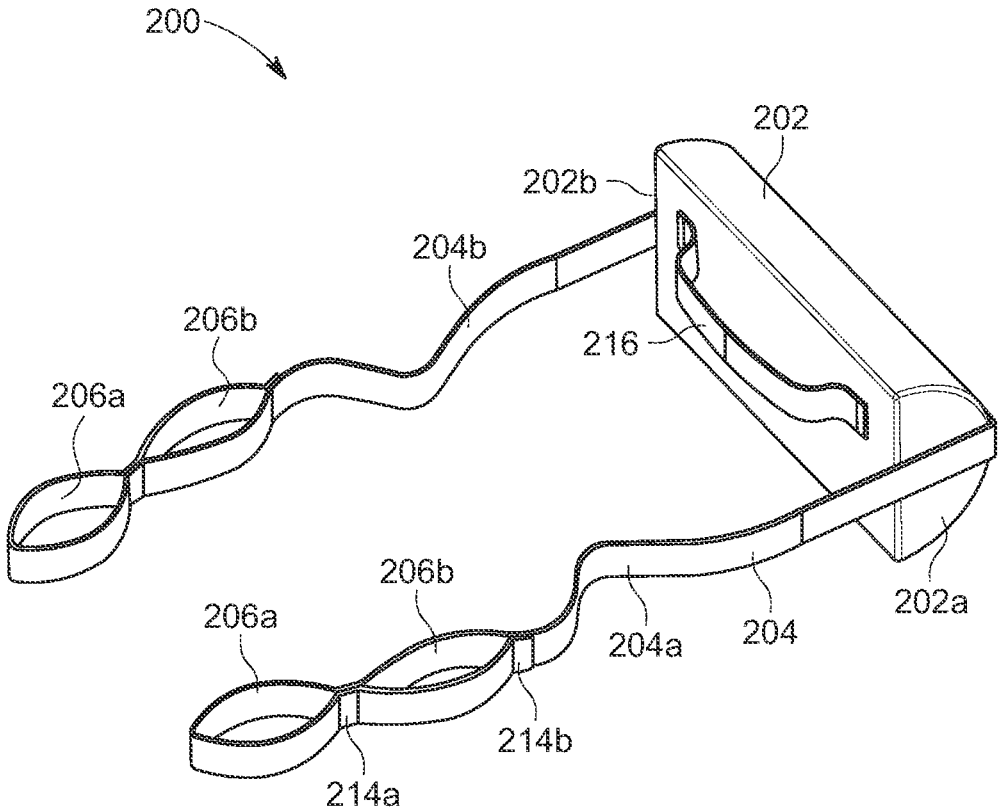
FIG. 3 depicts a perspective view of a knee joint physical therapy device according to another embodiment.

FIG. 3 depicts a perspective view of a knee joint physical therapy device 200 according to another embodiment. Knee joint physical therapy device 200 is comprised of a semicylindrical body 202 having a strap 204 attached thereto. Strap 204 is attached to the semicylindrical body 202 in a manner that will be described later. Strap 204 has a first strap end 204*a* and a second strap end 204*b*, the first strap end 204*a* attached to a first end 202*a* of the semicylindrical body 202 and the second strap end 204*b* attached to the second end 202*b* of the semicylindrical body 202. First strap end 204*a* and second strap end 204*b* each comprise a plurality of handles 206*a* and 206*b* for grasping by the patient. In other embodiments, physical therapy device 200 may comprise more than one strap. For example, the first strap end may be on a first strap attached at the first end of the semicylindrical body and the second strap end may be on the second strap attached at the second end of the semicylindrical body.

Figure 4:
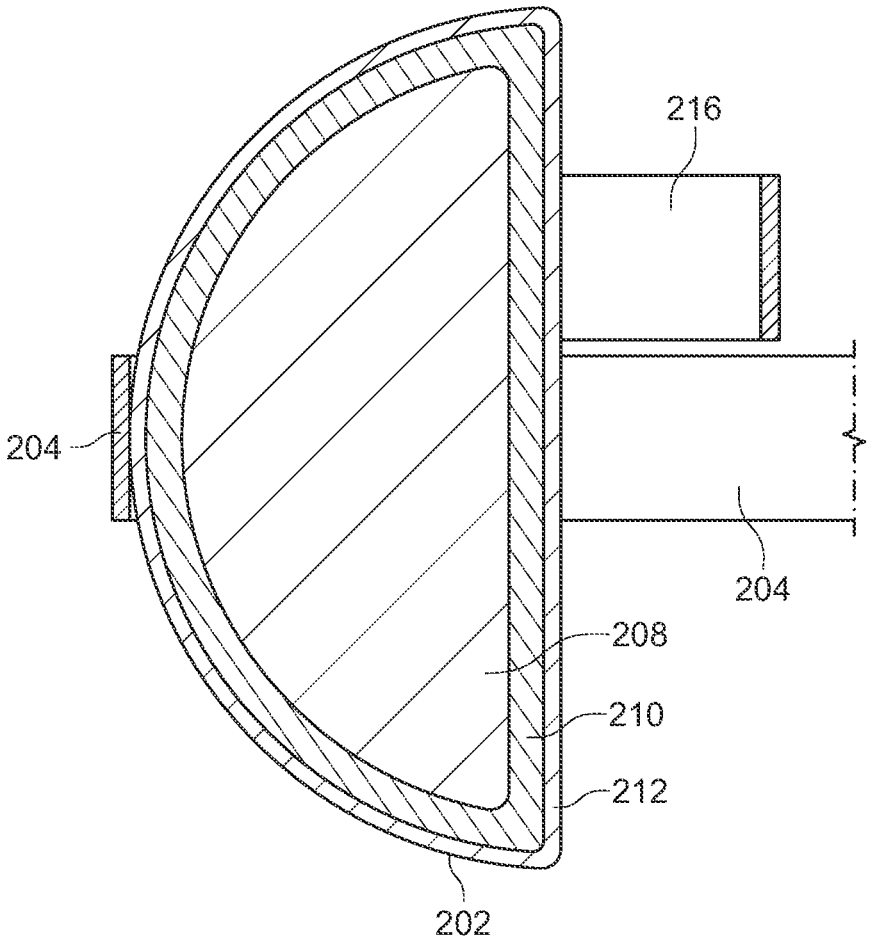
FIG. 4 depicts a cutaway view of a knee joint physical therapy device of FIG. 3.

FIG. 4 depicts a section view of semicylindrical body 202. Semicylindrical body 202 is comprised of a semicylindrical core 208, padding 210, and cover 212. The primary purpose of semicylindrical core 208 is to hold the semicylindrical shape of semicylindrical body 202. Semicylindrical core 108 may be rigid or semi-rigid and may be comprised of a hollow cylinder or solid semicylinder. The core may be extruded, injection molded, or blow molded and may be made out of polyvinylchloride (PVC), polystyrene, polyethylene or any other suitable polymer. The core may be formed of polystyrene, polyethylene or any other polymer foam which may be expanded, extruded, or otherwise formed.

Padding 210 surrounds semicylindrical core 208 and may be comprised of any compliant organic or inorganic material such as stuffing, ethylene-vinyl acetate (EVA) foam, polyurethane foam, polyethylene foam, neoprene foam, urethane foam, vinyl foam, silicone foam, PVC foam, memory foam, etc. Padding 210 provides a small amount of cushion for comfort without compressing too much and losing the support of the semicylindrical core 208.

Cover 212 completely surrounds padding 210 and semicylindrical core 208 around the circumference, flat side, and on both ends. Cover 212 is made of a leather, vinyl, or other suitable material to provide a hygienic, easy to clean surface for the device. Cover 212 may be made from one or more pieces attached to one another such as by sewing.

Strap 204 may be attached to semicylindrical body 202 by being sewn to cover 212. Strap 204 may be attached to both ends of semicylindrical body 202 as well as along the length of one side of the semicylindrical body. Strap 204 may be made of nylon webbing, polyurethane webbing, polyester webbing, or any other suitable material. Strap 204 comprises a plurality of handles 206*a* and 206*b* on either side on the strap. Handles 206*a* are at the ends of strap 204 and handles 206*b* are displaced between handles 206*a* and the semicylindrical body 202. These handles and more may be provided, thus allowing the patient to grasp whichever handles are preferable.

The handles may be made from a loop of the strap material or may be a separate piece attached to the strap. For example, the handles may be made of a plastic or metal loop attached to the strap by sewing, rivets, etc. In the embodiment shown in FIG. 3, handles 206*a* and 206*b* are formed by folding strap 204 back on itself and securing the two pieces of strap at a first location 214*a* and a second location 214*b*.

Retaining band 216 is comprised of a flexible material attached to the semicylindrical body 202 and is designed to help hold semicylindrical body 202 on a patient's foot. Retaining band 216 is attached to semicylindrical body 202 at two or more places, creating at least one opening for passing a foot or both feet of a patient therethrough. Retaining band 216 may be made of an elastic or inelastic material, such as nylon webbing, rubber, elastic, etc.

In use, the knee joint physical therapy device may be used for multiple physical therapy exercises designed to assist users with knee problems. One such exercise is known as a heel slide. The patient sits on a flat surface and places the cylindrical body 102 or the flat section of the semicylindrical body 202 against the foot and grasps a handle of the strap (106*a*, 106*b*, 206*a*, 206*b*) on each side of the cylinder. The patient then slides the heel toward and away from the body, pulling on the strap and thus assisting the foot to slide as necessary.

Another exercise that can be performed with a knee joint physical therapy device as described herein is a quad set. In the quad set, the patient lies on a flat surface and the cylindrical body (or semicylindrical body flat side down) is placed under the ankle to raise the leg off the floor. The straps and handles are not usually used and are placed out of the way. The knee is then pushed down toward the floor. The padding 110/210 (and possibly also the cover 112/212) provide some cushion for the patient while core 108/208 is sufficiently rigid to maintain the required support for the leg. The knee joint physical therapy device thus provides comfortable support for the ankle while the exercise is being performed.

Additionally, a knee joint physical therapy device as disclosed herein may also be used to perform a short arc quad exercise. In the short arc quad, the patient lies on a flat surface and the cylindrical body 102 (or semicylindrical body 202 with the flat side down) is placed under the knee, causing a bend in the knee when the foot is resting on the flat surface. The foot is then raised by straightening the leg at the knee. The handles and straps are not usually used and are placed out of the way. The padding 110/210 (and possibly also the cover 112/212) provide some cushion for the patient while core 108/208 is sufficiently rigid to maintain the required support for the leg. Thus, the knee joint physical therapy device provides comfortable support for the knee while the exercise is being performed.

It is contemplated that such device could take many forms without departing from the spirit of the invention. Any combination of features shown in the figures or described in this disclosure may be combined and thus the invention is not limited to the specific embodiments shown.

The discussion herein of the present invention is directed to various embodiments of the invention. The term "invention" is not intended to refer to any particular embodiment or otherwise limit the scope of the disclosure. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Herein, the terms "including," "consisting of", and "comprising" are used in an open-ended fashion, and thus should be interpreted to mean "including, but not limited to." Also, the term "connect" or "connected" where used if at all is intended to mean either an indirect or direct connection. Thus, if a first component connects to a second component, that connection may be through a direct connection or through an indirect connection via other components and connections.

Certain terms are used throughout the description and claims to refer to particular system components and method steps. As one skilled in the art will appreciate, different companies may refer to a component by different names. This document does not intend to distinguish between components that differ in name but not function.

It is to be understood that the disclosure is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A knee joint physical therapy device, comprising:

a cylindrical body having:

a rigid or semi-rigid core, and a cover surrounding the core, and at least one strap attached to the cylindrical body, the at least one strap comprising a first strap end extending from a first end of the cylindrical body and a second strap end extending from a second end of the cylindrical body, wherein the core comprises a solid cylinder, and wherein the first strap end comprises two handles and the second strap end comprises two handles.

2. The knee joint physical therapy device of claim 1, further comprising:

padding surrounding the core and between the core and the cover.

3. The knee joint physical therapy device of claim 1, wherein the solid cylinder comprises a polymer foam.

4. The knee joint physical therapy device of claim 1, wherein the handles are formed by a loop of the strap material.

5. The knee joint physical therapy device of claim 1, further comprising a retaining band attached to the cylindrical body for passing a foot or both feet of a patient therethrough.

6. A knee joint physical therapy device, comprising:

a semicylindrical body having:

a rigid or semi-rigid core, and a cover surrounding the core, and at least one strap attached to the semicylindrical body, the at least one strap comprising a first strap end extending from a first end of the semicylindrical body and a second strap end extending from a second end of the semicylindrical body, wherein the core comprises a solid semicylinder, and wherein the first strap end comprises two handles and the second strap end comprises two handles.

7. The knee joint physical therapy device of claim 6, further comprising:

padding surrounding the core and between the core and the cover.

8. The knee joint physical therapy device of claim 6, wherein the solid semicylinder comprises a polymer foam.

9. The knee joint physical therapy device of claim 6, wherein the handles are formed by a loop of the strap material.

10. The knee joint physical therapy device of claim 6, further comprising a retaining band attached to the semicylindrical body for passing a foot or both feet of a patient therethrough.

* * * * *